US009671174B2

(12) United States Patent
Strehlow et al.

(10) Patent No.: US 9,671,174 B2
(45) Date of Patent: Jun. 6, 2017

(54) THERMAL GROUND PLANE WITH TENSION ELEMENTS

(71) Applicant: Minco Products, Inc., Minneapolis, MN (US)

(72) Inventors: Russell H. Strehlow, St. Paul, MN (US); Peter M. Bobgan, Maple Grove, MN (US)

(73) Assignee: Minco Products, Inc., Minneapolis, MN (US)

( * ) Notice: Subject to any disclaimer, the term of this patent is extended or adjusted under 35 U.S.C. 154(b) by 0 days.

(21) Appl. No.: 15/029,421

(22) PCT Filed: May 11, 2015

(86) PCT No.: PCT/US2015/030119
§ 371 (c)(1),
(2) Date: Apr. 14, 2016

(87) PCT Pub. No.: WO2015/172136
PCT Pub. Date: Nov. 12, 2015

(65) Prior Publication Data

US 2016/0252308 A1 Sep. 1, 2016

Related U.S. Application Data

(60) Provisional application No. 61/991,008, filed on May 9, 2014.

(51) Int. Cl.
*F28F 7/00* (2006.01)
*F28D 15/00* (2006.01)
*F28D 15/04* (2006.01)

(52) U.S. Cl.
CPC ..... *F28D 15/04* (2013.01); *F28D 15/046* (2013.01)

(58) Field of Classification Search
CPC ..... F28D 15/02; F28D 15/04; F28D 15/0233; F28D 15/0283
(Continued)

(56) References Cited

U.S. PATENT DOCUMENTS 3,680,189 A * 8/1972 Noren ..... B21D 53/02 165/104.26
5,216,580 A * 6/1993 Davidson ..... F28D 15/0266 165/104.33
(Continued)

FOREIGN PATENT DOCUMENTS

JP 2001241870 A 9/2001

OTHER PUBLICATIONS

International Search Report and Written Opinion written by Blaine Copenheaver dated Aug. 10, 2015 in re PCT/US2015/030119 (9 pages).

*Primary Examiner* — Len Tran
*Assistant Examiner* — Claire Rojohn, III
(74) *Attorney, Agent, or Firm* — Dicke, Billig & Czaja, PLLC

(57) ABSTRACT

A thermal ground plane includes a casing having a first casing portion and a second casing portion, the first casing portion united with the second case portion via an ultrasonic weldment so as to delimit a hermetically sealed casing chamber. A phase-change media, a wicking structure and a spacing element are further characteristic of the device, each of which resides within the casing member. The wicking structure is adjacent the first casing portion of the casing, with the spacing element intermediate the wicking structure and the second casing portion.

26 Claims, 3 Drawing Sheets

(58) Field of Classification Search
USPC .... 165/80.4, 104.19, 104.21, 104.26, 104.33
See application file for complete search history.

(56) References Cited

U.S. PATENT DOCUMENTS

| | | | | |
|---|---|---|---|---|
| 6,446,706 | B1 * | 9/2002 | Rosenfeld | F28D 15/0241 165/104.26 |
| 6,665,180 | B2 * | 12/2003 | Lehman | G06F 1/20 165/104.33 |
| 7,278,469 | B2 | 10/2007 | Sasaki et al. | |
| 7,843,695 | B2 | 11/2010 | Yang et al. | |
| 7,995,344 | B2 * | 8/2011 | Dando, III | H05K 7/20454 165/104.33 |
| 8,074,706 | B2 * | 12/2011 | Su | F28D 15/046 165/104.26 |
| 8,335,083 | B2 | 12/2012 | Yang et al. | |
| 8,997,839 | B2 * | 4/2015 | Yang | F28D 15/046 165/104.19 |
| 9,021,698 | B2 | 5/2015 | Yang | |
| 2003/0159806 | A1 * | 8/2003 | Sehmbey | F28D 15/0233 165/80.3 |
| 2003/0210527 | A1 * | 11/2003 | Saita | F28D 15/0233 361/700 |
| 2006/0124280 | A1 * | 6/2006 | Lee | F28D 15/0233 165/104.26 |
| 2008/0210407 | A1 | 9/2008 | Kim et al. | |
| 2010/0294461 | A1 | 11/2010 | Weaver, Jr. et al. | |
| 2011/0017431 | A1 | 1/2011 | Yang et al. | |
| 2011/0048672 | A1 | 3/2011 | Martin et al. | |
| 2011/0108245 | A1 * | 5/2011 | Tan | F28D 15/04 165/104.26 |
| 2011/0120674 | A1 * | 5/2011 | MacDonald | F28D 15/046 165/104.26 |
| 2011/0186268 | A1 * | 8/2011 | Yang | F28D 15/02 165/104.26 |
| 2013/0327504 | A1 | 12/2013 | Bozorgi et al. | |

* cited by examiner

THERMAL GROUND PLANE WITH TENSION ELEMENTS

CROSS-REFERENCE TO RELATED APPLICATIONS

This Utility Patent Application is a U.S. National Stage filing under 35 U.S.C. §371 of PCT/US2015/030119, filed May 11, 2015, which is an international application filed under 35 USC Ɜ 363 claiming priority under 35 USC Ɜ 120 of/to U.S. Pat. Appl. Ser. No. 61/991,008 filed May 9, 2014 and entitled THERMAL GROUND PLANE, the disclosure of which is hereby incorporated by reference in its entirety.

TECHNICAL FIELD

The present disclosure is generally directed to one or more of thermal ground planes, thermal ground plane structures, methods of thermal energy management, and methods of fabricating such planes and/or structures, more particularly, to thermal ground planes and/or structures having a chamber characterized by an improved peripheral hermetic seal and/or interior chamber tension elements or members.

BACKGROUND

Power generating electronic and optical devices/systems, as well as energy conversion and storage systems such as fuel cells and the like, have become increasingly compact. At stake has been and is thermal energy management performance, and thus, the reliability of such devices and systems. Increasingly and currently, it is generally believed that improved thermal energy management is requisite to advance such high performance electronic, optical and energy conversion/storage devices and/or systems.

Heat pipes, thermal ground planes and vapor chambers (a/k/a flat heat pipes) are frequently employed for the above noted thermal energy management. Characteristically, such devices combine principles of both thermal conductivity and phase transition to effectively manage a transfer of heat between two solid interfaces. More particularly, such passive heat transfer devices utilize capillary forces to circulate a working fluid between discrete evaporator and condenser regions of a vacuum tight housing, compartment, shell or vessel.

With regard to such devices, a working fluid occupies a vapor chamber having an evaporating surface and a condensing surface opposite to the evaporating surface. The evaporating surface is intended to engage/contact a heat source to absorb the heat of the heat source, thereby heating and evaporating the working fluid in the vapor chamber. When the vapor is brought into contact with a "cold" surface (i.e., the condensing surface), the vapor condenses into liquid to release the latent heat of the working fluid. With the phase change between vapor and liquid of the working fluid, the heat of the heat source can be conducted to the condensing surface.

Heat pipes are generally inexpensive, reliable, and long lived, thus they are in wide use. Moreover, they provide effective heat removal over long distances and are well suited for applications characterized by high g-forces, shock, vibration, and freeze/thaw. Further still, their use enables smaller and more compact arrangements of electronics as is characteristic of hand held devices and avionics. Present technical efforts include those directed to flexible and conformal thermal grounds planes, more particularly, to ease of manufacture and reliability thereof.

Rosenfeld et al. (U.S. Pat. No. 6,446,706), and later Kim et al. (U.S. Pub. No. 2008/0210407 A1) citing same, both incorporated herein by reference in their entireties, generally express concerns relating to the exacerbated tensions of maintaining uniform lamina contacts in furtherance of predictable, repeatable and reliable heat transfer, and establishing suitable capillary force/wicking, to facilitate phase change of a working fluid, in the context of thin, flat panel type heat transfer devices. As to the former, each outer heat pipe wall of the purportedly especially flexible heat pipe is characterized by a plurality of lamina, among others, two/dual metal foil layers intended to function as barriers to material ingress/egress. As to the later, in furtherance of an aim of ensuring high thermal conductivity at a low cost, a panel type heat transfer device characterized by one or more aggregated hydrophilllic fiber wick structures and a directional coolant passage is provided. Be that as it may, manufacturing ease for such devices has remained elusive, with reliability wanting.

Issues of low production yield, low vapor-liquid circulation efficiency, and poor internal supporting strength remain as indicated by Yang et al. (U.S. Pat. No. 8,997,839) and Yang (U.S. Pat. No. 9,021,698), each incorporated herein by reference in their entireties. The former teaching provides a thin sheet element characterized by intersectingly extending sections which define element openings, and bosses fixedly located in select openings thereof, the bosses and thin sheet member being disposed in a receiving space of a pipe body at the same time. The latter teaching provides a flat plate heat pipe characterized by only two soldered sealing joints (i.e., the pipe is flattened and the two free ends sealed) and a sintered supporting layer which functions to avoid plate deformation while apertures thereof permit passage of a phase-change media therethrough and there across.

Beyond the aforementioned developments and perceived shortcomings, capillary wick structures have deservingly been a focal point for thermal ground plane advancement. With reliance upon material science advances, improved thermal conductivity and coefficient of thermal expansion matching have been generally realized in and for capillary wick structures, with working in this area ongoing. Conventional metal powder based wicking structures (e.g., sintered copper) have generally been succeeded, for instance and without limitation, by those characterized by copper foam, copper micro and nano structures (and hybrids thereof), with and without a hydrophilic coating (e.g., an atomic layer deposited (ALD) film), diamond-copper composites, titanium and titania micro and nano structures, and carbon micro and nano structures.

Be that as it may, it is well known and appreciated that a hermetic seal of the thermal ground plane structure is considered critical. Generally known and practiced techniques or methods include, for example, solder bonding, polymer bonding, vacuum brazing, and electron beam welding. Moreover, in addition to a combined bonding approach such as one characterized by a fluorinated ethylene propylene (FEP), e.g., Teflon®, bond with a soldered perimeter or periphery, metal plating over an FEP bonded structure or element, as by ALD, is likewise known and practiced.

While a variety of sealing techniques are known, it is believed advantageous and desirable to overcome known shortcomings. For instance, polymer bonded device peripheries are known to be gas permeable and of suspect reliability for the long haul, with solder bonded device peripheries, by their nature, introducing a potential deleterious solder alloy and/or solder flux contamination interior of the seal (i.e., reacting with the working medium within the chamber), with such union providing/imparting no mechanical strength. Moreover, metal plating over a bonded device periphery to form or fortify the hermetic seal may not be feasible, and contrariwise, it likewise introduces a potential deleterious plating fluid contamination interior of the seal (i.e., reacting with the working medium within the chamber). Finally, while more reliable hermetic seals are achievable, the relative high cost prevents their ubiquitous application.

In light of the foregoing, there thus remains a need to provided a low cost, long lived thermal ground plane characterized by a highly reliable hermetic seal. Moreover, there thus remains a need to provided a low cost, long lived thermal ground plane having structural chamber members formable within a device periphery characterized by a highly reliable unions of select opposing chamber portions. Further still, it is believed desirable and advantageous to provide an elegant, low cost process for fabricating high reliability thermal ground planes.

SUMMARY OF THE INVENTION

A thermal ground plane is generally provided. The device includes a casing characterized by a first casing portion and a second casing portion, the first casing portion united with the second case portion via an ultrasonic weldment so as to delimit a hermetically sealed casing chamber. A surface of the first casing portion comprises a casing condenser section and a surface of the second casing portion comprises a casing evaporator section. A phase-change media resides within the casing chamber, along with a wicking structure and a spacing or vapor element. The wicking structure, which among other things aids phase-change of the phase change media, is adjacent the first casing portion of the casing. The spacing element, which among other things likewise aids phase-change of the phase change media, is intermediate the wicking structure and the second casing portion.

Advantageously, as circumstances warrant, opposing casing portions are selectively united via an ultrasonic weldment in furtherance of forming tensioning elements within the casing chamber. The tensioning elements comprise at least portions of each of the first casing portion and the second casing portion, however, the tensioning elements may alternately comprise portions of each of the first casing portion, the wicking structure, the spacing element, and the second casing portion.

Further still, the subject thermal ground plane may further include a metal/metal alloy coating, namely, a metal coating overlaying the ultrasonic weldments of the device. Advantageously, the metal coating may be a soldered coating or a brazed coating.

Finally, a thermal ground plane precursor is provided. The precursor is generally characterized by a working envelope having a first envelope portion and a second envelope portion. The first envelope portion is united with the second envelope portion via a primary ultrasonic weldment so as to delimit an envelope chamber. The first envelope portion and the second envelope portion are further united via a secondary ultrasonic weldment partially traversing the working envelope so as to substantially delimit first and second envelope compartments, the first envelope compartment characterized by a phase-change media filling port. A phase-change media resides within the working envelope. A wicking structure resides within the second envelope compartment adjacent a portion of the first envelope element, and a spacing element likewise resides within the second envelope compartment intermediate the wicking structure and a portion of the second envelope portion. Subsequent to introducing the phase change media to the working envelope, the secondary ultrasonic weldment is adapted so as to fully traverse and bifurcate the working envelope and thereby delimit a casing, the casing being commensurate with the first envelope compartment, the first envelope compartment thereafter removable in furtherance of delimiting a thermal ground plane characterized by a chargeportless casing. More specific features and advantages obtained in view of those features will become apparent with reference to the drawing figures and DETAILED DESCRIPTION OF THE INVENTION.

BRIEF DESCRIPTION OF THE DRAWINGS

The assembly, subassemblies, apparatus, structures and/or elements disclosed directly or implicitly herein may be embodied in other specific forms without departing from the spirit or general characteristics thereof, some of which forms have been indicated. Thus, the features described and depicted herein/herewith are to be considered in all respects illustrative and not restrictive. Moreover, in-as-much-as structures have been assigned select unique reference characters through the subsequent written description, and which correlate to at least one drawing of the instant drawings, the identification of all depicted structures in any given drawing via the inclusion of reference characters has been superceded for the sake of clarity. The drawings are described as follows.

DETAILED DESCRIPTION OF THE INVENTION

As a preliminary matter, the instant disclosure generally sets forth illustrative, non-limiting thermal ground planes characterized by casing having a hermetic ultrasonic welded seal. Moreover, internal structural members or elements (e.g., tension members or "posts") of or for such device are delimited by a select ultrasonic welded unions of device portions. Finally, in addition to such devices, a precursor device is disclosed, with attendant methods of fabricating the contemplated device/device precursor likewise disclosed.

Figure 1:
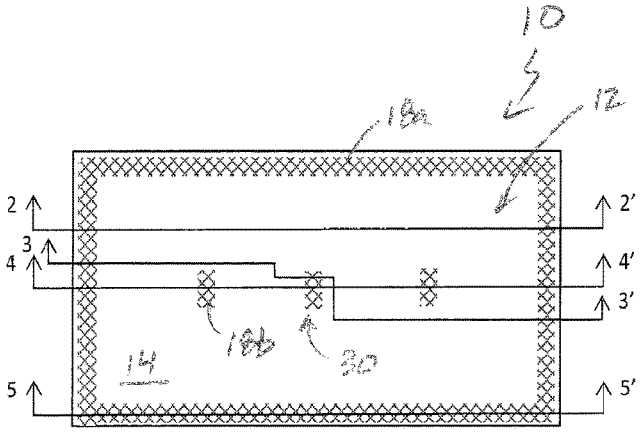
FIG. 1 depicts, schematic plan, a representative, non-limiting thermal ground plane characterized by ultrasonically welded unions delimiting both a hermetically sealed device periphery and internal tension members.
Figure 5:
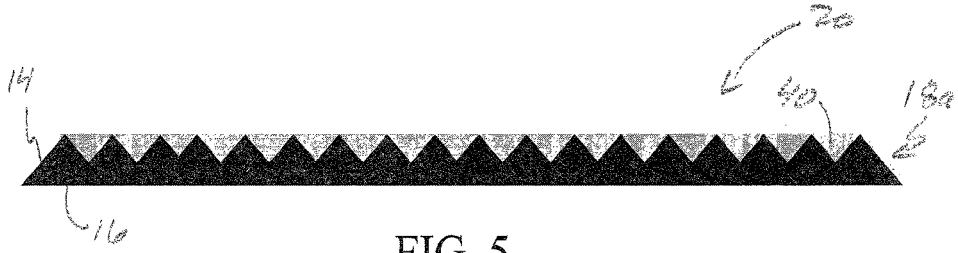
FIG. 5 is a sectional view about line 5-5' of the thermal ground plane of FIG. 1 schematically indicating ultrasonically united casing portions, namely, a hermetically sealed and fortified chamber periphery.
Figure 6:
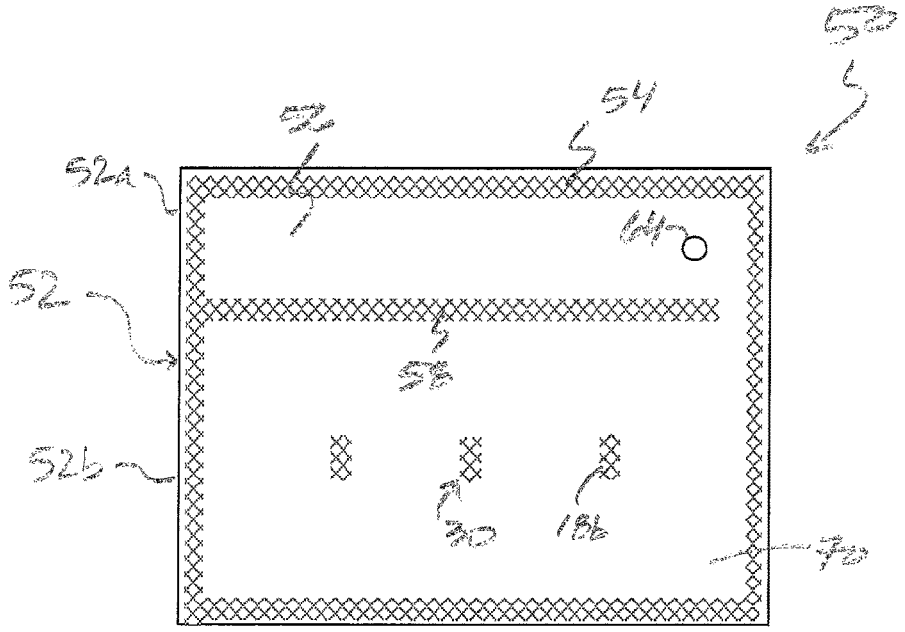
FIG. 6 depicts, schematic plan, a representative, non-limiting precursor of the thermal ground plane of FIG. 1; and, FIG. 7 depicts, schematic plan, adaptations relative to the FIG. 6 precursor.
Figure 7:
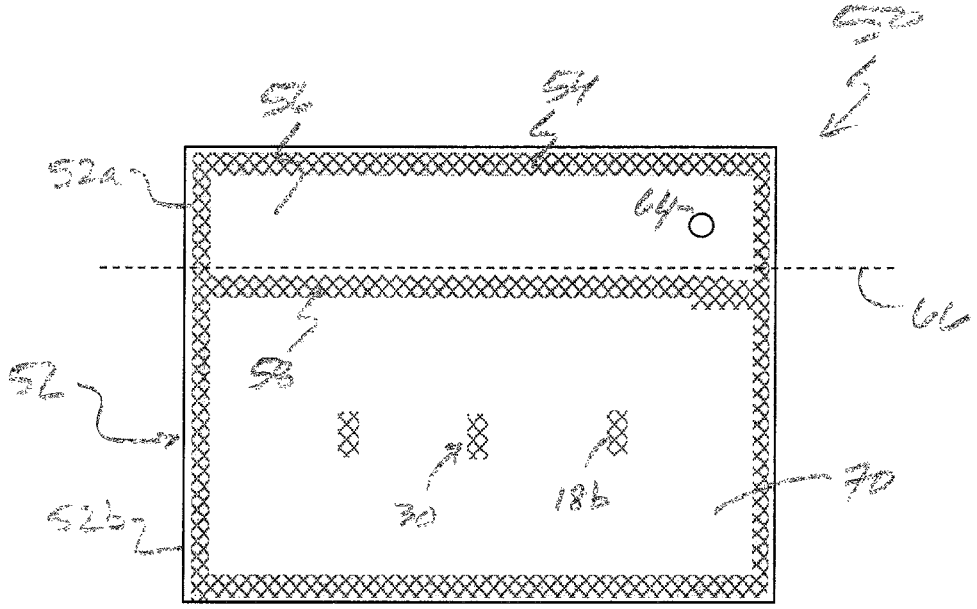

By way of overview, a thermal ground plane, plan view, is schematically illustrated in FIG. 1, with a thermal ground plane precursor and adaptation thereof depicted in FIGS. 6 & 7 respectively. First, second, third and fourth representative, non-limiting sections of the thermal ground plane of FIG. 1 are provided in FIGS. 2-5; the first emphasizing a device casing and elements thereof; the second emphasizing an advantageous tensioning element characterized by direct union of opposed casing portions; the third emphasizing a further advantageous, alternate tensioning element characterized by a union of opposed device portions; and, the fourth emphasizing an advantageous peripheral union of opposed device casing members.

While the balance of the instant disclosure speaks to flexible thermal ground planes (FTGPs), Applicant's subject matter is not intended to be so limited. Moreover, while advantageous and even preferred features are disclosed, in addition to particulars for the contemplated thermal ground plane and its precursor (i.e., specifications for the device and its components), it is to be understood that such disclosure is illustrative and not intending to be limiting, with departures as to same contemplated.

Figure 2:
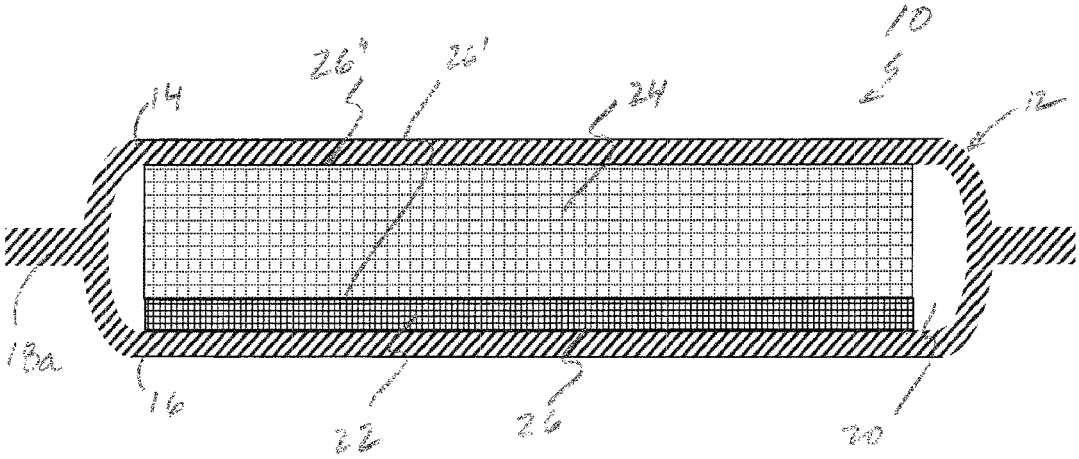
FIG. 2 is a sectional view about line 2-2' of the thermal ground plane of FIG. 1.

With initial reference to FIGS. 1 & 2, there is generally shown, in two views, a thermal ground plane 10. The device generally includes a casing 12 characterized by a first casing portion 14 and a second casing portion 16 (FIG. 2), the first casing portion united with the second case portion via an ultrasonic weldment 18, i.e., a peripheral ultrasonic weldment 18*a*, so as to delimit a hermetically sealed casing chamber 20 (FIG. 2), a phase-change media, a/k/a, a working fluid, generally residing therein. The device further and generally includes a wicking structure 22 and a spacing or vapor element 24, each of which resides within casing chamber 20 (FIG. 2). Wicking structure 22 is adjacent second casing portion 16 of easing 12, more particularly, an interior surface of the second casing portion (i.e., a casing condenser segment, portion, or region). More particularly, and advantageously, a bonded interface for, between and among the wicking structure and the second casing portion is provided, for example and without limitation, via a diffusion bonded interface 26. Spacing element 24 is intermediate wicking structure 22 and first casing portion 14, more particularly, an interior surface of the first casing portion (i.e., a casing evaporator segment, portion, or region). Advantageously, but hardly exclusively, diffusion bonding of all lamina of the casing, i.e., each lamina-lamina interface, is contemplated, e.g., a diffusion bonded interface 26' is contemplated for, between and among wick structure 22 and spacer element 24, and a diffusion bonded interface 26 is contemplated for between and among spacer element 24 and first casing portion 14, with both thermal and mechanical advantage realized. As to the latter, via a structurally unified chamber interior via the bonded lamina interfaces, this approach is believed a functional alternative to the tensioning elements contemplated in select applications, however, a device characterized by both features is believed desirable.

Figure 3:
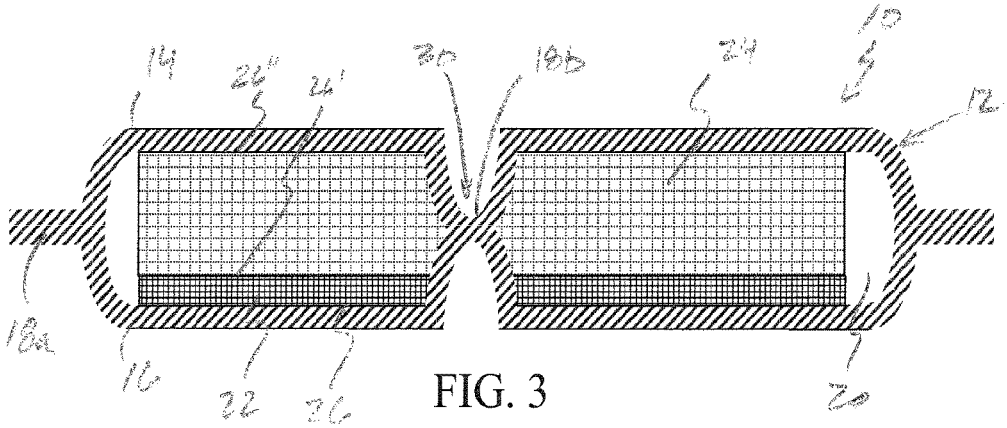
FIG. 3 is a sectional view about line 3-3' of the thermal ground plane of FIG. 1 indicating a tension member section.
Figure 4:
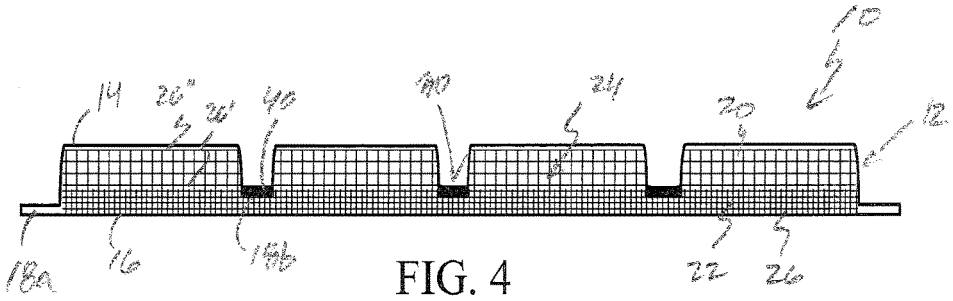
FIG. 4 is an alternate sectional view, about line 4-4', of the thermal ground plane of FIG. 1 schematically indicating an alternate tension member section.

With reference now to FIGS. 1, 3 & 4, tension elements 30 are advantageously and variably contemplated as shown. Notionally, such elements function to maintain the structural integrity of the casing, more particularly, the structural integrity of the casing chamber, the location and number of such elements being part-and-parcel of a given application and its aims. Advantageously, opposing casing portions are selectively united via an ultrasonic weldment, i.e., an interior ultrasonic weldment 18*b*, in furtherance of forming tensioning elements 30 within casing chamber 20.

In connection to FIG. 3, opposing casing portions 14, 16 are selectively united via ultrasonic weldment 18*b* in furtherance of forming tensioning elements 30 within casing chamber 20, each tensioning element solely characterized by portions of each of first casing portion 14 and second casing portion 16. In furtherance of manufacturing ease, more particularly, registration and retention of device lamina during operations in furtherance of chamber formation, internal lamina may be adapted to include a select arrangement or configuration of apertures within their peripheries, these locals being subject of interior weldment operations yielding the tensioning elements depicted.

In connection to FIG. 4, and in contradistinction to FIG. 3, opposing casing portions may be selectively united via an ultrasonic weldment 18*b* in furtherance of forming tensioning elements 30 within casing chamber 20, each tensioning element characterized by portions of each of first casing portion 14, wicking structure 22, spacing element 24, and second casing portion 16. Via a single step, all weldments may be made, and in a less than atmospheric environment, the weldments possess sufficient strength to maintain casing integrity, and critically sufficient cooperative engagement of the casing elements, e.g., the wicking structure and its adjacent casing portion, in furtherance of effective heat transfer.

The weldment is ultrasonically applied. Via a localized application of high-frequency ultrasonic acoustic vibrations to a workpiece, e.g., overlaying casing portions or opposed chamber portions, a solid-state weldment is formed or formable. In-as-much as any of a seam weld, an overlapping spot weld, and/or an overlapping line weld is contemplated and believed suitable for the formation of either and/or both of a hermetic casing seal and tension elements, a seam weld is understood to be especially advantageous.

As is best appreciated with reference to either or both of FIGS. 4 & 5, an especially advantageous embodiment of the contemplated thermal ground plane further includes a metal/metal alloy coating 40, more particularly, a coating of same upon ultrasonic weldments 18 of the device. Owing to the weld process, localized deformation of casing material may cause a thinning of the material thickness. Moreover, the geometry of the interior weld interface creates stress risers. Application of the metal/metal alloy coating over the weldments strengthens and rigidizes the areas to reduce applied stresses.

The casing portions of the device casing comprise impermeable lamina. Elemental metal, namely, copper or aluminum, and more particularly, foils thereof are preferred but by no means intended to be limiting. Copper foil is especially advantageous owing to its compatibility with water, a common and desirable phase change media or working fluid. Generally, the impermeable lamina is within a thickness range of about 1-10 mils, with a 3-5 mil thickness advantageous for copper or aluminum foils owing to a good mix of strength versus weight. In applications where the impermeable lamina would/could create an electrical short in a system where the sought after heat management is to be conducted, the otherwise advantageous lamina may be readily adapted so as to selectively include a dielectric. While, for the sake of optimal heat transfer/conductance, evaporator and condenser portions of the thermal ground plane are to be free of the generally insulative dielectric, applications may warrant a departure from less than ideal circumstances. Conventional dielectric films, conventionally applied to the impermeable lamina are contemplated, with adhesively applied polyimide believed advantageous.

The wicking structure preferably but not necessarily comprises a layered wicking structure. Conventional wicking structures are generally contemplated, e.g., and without limitation, a micro-mesh, a felt, or a sintered material, with copper preferred owing to its ubiquitous acceptance as a neutral element, i.e., it does not contribute to the formation of deleterious non-condensable gases. As to wicking structure thickness, a balancing of performance aims are commonly in play, e.g., thermal objectives versus physical constraints. Cooperative engagement of the wicking structure with the evaporator the device is believed advantageous, a diffusion bonded interface for, between and among the structure and its adjacent casing portion is preferred.

The vapor spacing element may suitably take a variety of forms and comprise one of many well know materials. Be that as it may, a metal mesh, e.g., copper mesh, is preferred owing to its simplicity and its general inertness and compatibility with diffusion bonding in a copper to copper context. In connection to a stack-up for removing heat from a 25 watt heat generating source such as an electronic component, the following working example is provided: 2 mil polyimide, 1 mil acrylic adhesive, 4 mil copper foil, 16 mesh copper with 10 mil diameter wire, three layers of 200 mesh copper with 2.5 mil wire diameter, 4 mil copper foil, 1 mil acrylic adhesive, 2 mil polyimide. Representative non-limiting device applications include component cooling in connection to circuit boards or other high powered electronic arrays, or battery pack cooling/heat spreading.

Finally, and with reference to FIGS. 6 & 7, an advantageous thermal ground plane precursor 50 is provided. As will be described, and appreciated in connection thereto, the fabrication approach for the contemplated thermal ground plane results in a "chargeportless" casing, i.e., the hermetic ultrasonic periphery weldment delimiting the casing chamber of the device is not adulterated via post manufacture/post manufacture working fluid charging. Needless to say, such approach greatly aids performance reliability and a long lived performance reliability.

The precursor, as shown, is generally characterized by a working envelope having a first envelope portion and a second envelope portion. The first envelope portion is united with the second envelope portion via a primary ultrasonic weldment so as to delimit an envelope chamber. The first envelope portion and the second envelope portion are further united via a secondary ultrasonic weldment partially traversing the working envelope so as to substantially delimit first and second envelope compartments, the first envelope compartment characterized by a phase-change media filling port (FIG. 6), with a phase-change media residing within the working envelope.

A wicking structure resides within the second envelope compartment adjacent a portion of the first envelope element, and a spacing element likewise resides within the second envelope compartment intermediate the wicking structure and a portion of the second envelope portion (see e.g., FIG. 2 as to particulars). Subsequent to introducing the phase change media to the working envelope, the secondary ultrasonic weldment is adapted so as to fully traverse and bifurcate the working envelope and thereby delimit a casing (FIG. 7), the casing being commensurate with the first envelope compartment. Once so adapted, the first envelope compartment is thereafter removed, as generally indicated via the broken line through the first envelope adjacent the formed casing chamber, in furtherance of delimiting a thermal ground plane characterized by a chargeportless casing.

Benefits accruing from hermetic seals or device unions characterized by ultrasonic weldments or the like are believed numerous. For instance, and without limitation, such approach enables significantly lower cost manufacture of FTGP than vacuum brazing or electron beam welding; introduces little or no non-copper surfaces to the interior chamber of the FTGP (NB: it is a common problem for the long term reliability of heat pipes and vapor chambers for non-standard materials to react with the working medium overtime and form non-condensable gases inside the device, thus negatively impacting its heat transfer performance; copper is the standard for water based heat pipes); provides structural reinforcements for low atmospheric operating environments; enables an efficient means to seal the charging port while actively interfaced with charging apparatus, again with less or no exposure non-copper surfaces; provides a means to charge the FTGP without leaving any charging port appendage(s) on the final product, and thus, amongst other things, reducing the chance of accidental damage and resulting device failure; and, it makes the benefits of a FTGP economically accessible to a wide range of applications.

In addition to the structures depicted and described, several further related items are noteworthy. More particularly, a copper to copper hermetical sealing process for FTGPs, the formation or establishment of copper to copper tension elements or structures, and, a metal alloy coating that enhances or fortifies the durability of the formed union or joint.

With regard to the copper to copper hermetic sealing process, preferably, but not necessarily, the process is characterized by a seam weld. Alternatively, overlapping spot or line ultrasonic welds are contemplated. The weld provides both a hermetic seal and necessary mechanical strength. Moreover, a large (i.e., >12"×12") device geometry is enabled via the subject low cost approach in contradistinction to processes currently and commonly used to hermetically seal small diameter tubes, and for hermetically sealing electronic device packages <0.5" in length/width.

With regard to the formation of copper to copper tension members, multiple layers/lamina are contemplated for union in a single step, e.g., all copper materials, through exterior foils and interior wicking and vapor spacing materials. The resulting device provides necessary strength to hold the device/envelope together in less than atmospheric environment.

Finally, with regard to the metal alloy coating for enhanced weld joint durability, it is generally understood that the weld process causes localized deformation of copper that can reduce the foil thickness. Post weld solder/braze process strengths these areas. Moreover, with the geometry of the interior weld interface creating stress risers, the post weld solder/braze process rigidizes these areas so as to spread out the stress.

Since the structures of the assemblies, subassemblies, and/or mechanisms disclosed herein may be embodied in other specific forms without departing from the spirit or general characteristics thereof, some of which forms have been indicated, the embodiments described and depicted herein/with are to be considered in all respects illustrative and not restrictive. Moreover, while nominal processing has been described and detailed, and to some degree alternate work pieces and systems, assemblies, etc. with regard thereto referenced, contemplated processes are not so limited. Accordingly, the scope of the subject invention is as defined in the language of the appended claims, and includes not insubstantial equivalents thereto.

That which is claimed:

1. A thermal ground plane comprising:

a. a casing characterized by a first casing portion and a second casing portion, said first casing portion united with said second case portion via an ultrasonic weldment so as to delimit a hermetically sealed casing chamber, a surface of said first casing portion comprising a casing condenser section, a surface of said second casing portion comprising a casing evaporator section, opposing casing portions are selectively united via an ultrasonic weldment in furtherance of forming tensioning elements within said casing chamber, said casing further comprises a metal coating, said metal coating overlaying ultrasonic weldments;

b. a phase-change media, said phase-change media residing within said casing chamber;

c. a wicking structure to aid phase-change of said phase change media, said wicking structure residing within said casing chamber adjacent said second easing portion of said casing; and, d. a spacing element to aid phase-change of said phase of said phase change media, said spacing element residing within said casing chamber intermediate said wicking structure and said first casing portion.

2. The thermal ground plane of claim 1 wherein said metal coating is a soldered coating.

3. The thermal ground plane of claim 1 wherein said metal coating is a brazed coating.

4. A thermal ground plane comprising:

a. a casing characterized by a first casing portion and a second casing portion, said first casing portion united with said second case portion via an ultrasonic weldment so as to delimit a hermetically sealed casing chamber, a surface of said first casing portion comprising a casing condenser section, a surface of said second casing portion comprising a casing evaporator section, opposing casing portions are selectively united via an ultrasonic weldment in furtherance of forming tensioning elements within said casing chamber;

b. a phase-change media, said phase-change media residing within said casing chamber;

c. a wicking structure to aid phase-change of said phase change media, said wicking structure residing within said casing chamber adjacent said second casing portion of said casing; and, d. a spacing element to aid phase-change of said phase of said phase change media, said spacing element residing within said casing chamber intermediate said wicking structure and said first casing portion, opposing casing portions selectively united via an ultrasonic weldment in furtherance of forming tensioning elements within said casing chamber, each tensioning element of said tensioning elements comprised of portions of each of said first casing portion, said wicking structure, said spacing element, and said second casing portion.

5. A thermal ground plane comprising:

a. a casing characterized by a first casing portion and a second casing portion, said first casing portion united with said second case portion via an ultrasonic weldment so as to delimit a hermetically sealed casing chamber, a surface of said first casing portion comprising a casing condenser section, a surface of said second casing portion comprising a casing evaporator section, said casing further comprises a metal coating, said metal coating overlaying said ultrasonic weldment;

b. a phase-change media, said phase-change media residing within said casing chamber;

c. a wicking structure to aid phase-change of said phase change media, said wicking structure residing within said casing chamber adjacent said second casing portion of said casing; and, d. a spacing element to aid phase-change of said phase of said phase change media, said spacing element residing within said casing chamber intermediate said wicking structure and said first casing portion.

6. The thermal ground plane of claim 5 wherein opposing casing portions are selectively united via an ultrasonic weldment in furtherance of forming tensioning elements within said easing chamber, each tensioning element of said tensioning elements comprised of portions of each of said first casing portion and said second casing portion.

7. The thermal ground plane of claim 5 wherein said metal coating is a soldered coating.

8. The thermal ground plane of claim 5 wherein said metal coating is a brazed coating.

9. The thermal ground plane of claim 5 wherein said wicking structure comprises a layered wicking structure.

10. The thermal ground plane of claim 5 wherein said wicking structure is bondingly united with said second easing portion of said casing to ensure uniform thermal conduction between a heat source and said wicking structure.

11. The thermal ground plane of claim 5 wherein said wicking structure comprises copper.

12. The thermal ground plane of claim 5 wherein said wicking structure comprises any of a layer or layers of a copper micro-mesh, a copper felt, or a sintered copper.

13. The thermal ground plane of claim 5 wherein said spacing element comprises copper.

14. The thermal ground plane of claim 5 wherein said spacing element comprises a copper mesh.

15. The thermal ground plane of claim 5 wherein said phase change media comprises water.

16. The thermal ground plane of claim 5 wherein said casing is characterized by a diffusion bond throughout each interior interface associated with said casing.

17. The thermal ground plane of claim 5 wherein said wicking structure is bondingly united with said second casing portion of said casing, said spacing element is bondingly united with said wicking structure, and said first casing portion is bondingly united with said spacing element.

18. A thermal ground plane precursor comprising:

a. a working envelope characterized by a first envelope portion and a second envelope portion, said first envelope portion united with said second envelope portion via a primary ultrasonic weldment so as to delimit an envelope chamber, said first envelope portion and said second envelope portion further united via a secondary ultrasonic weldment partially traversing said working envelope so as to substantially delimit first and second envelope compartments, said first envelope compartment characterized by a phase-change media filling port;

b. a phase-change media, said phase-change media residing within said working envelope;

c. a wicking structure to aid phase-change of said phase change media, said wicking structure residing within said second envelope compartment adjacent a portion of said second envelope portion; and, d. a spacing element to aid phase-change of said phase of said phase change media, said spacing element residing within said second envelope compartment intermediate said wicking structure and a portion of said first envelope portion, subsequent to introducing said phase change media to said working envelope, said secondary ultrasonic weldment adapted so as to fully traverse and bifurcate said working envelope and thereby delimit a casing, said casing commensurate with said first envelope compartment, said first envelope compartment thereafter removable in furtherance of delimiting a thermal ground plane characterized by a chargeportless casing.

19. The thermal ground plane of claim 5 wherein said at least a portion of said casing selectively includes an exterior dielectric layer.

20. The thermal ground plane of claim 5 wherein said ultrasonic weldment comprises a seam weld.

21. The thermal ground plane of claim 5 wherein said ultrasonic weldment comprises an overlapping spot weld.

22. The thermal ground plane of claim 5 wherein said ultrasonic weldment comprises an overlapping line weld.

23. The thermal ground plane of claim 5 wherein, said casing comprises an elemental metal.

24. The thermal ground plane of claim 23 wherein said casing comprises copper.

25. The thermal ground plane of claim 23 wherein said casing comprises a copper foil having a thickness within a range of about 1-10 mils.

26. The thermal ground plane of claim 23 wherein said casing comprises aluminum.

* * * * *